US009952548B2

(12) United States Patent
Ueno

(10) Patent No.: US 9,952,548 B2
(45) Date of Patent: Apr. 24, 2018

(54) IMAGE FORMING APPARATUS AND IMAGE FORMING METHOD HAVING DECOLORIZING FUNCTION IN THE IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshiyuki Ueno, Shimizu Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/218,676

(22) Filed: Jul. 25, 2016

(65) Prior Publication Data

US 2017/0068191 A1 Mar. 9, 2017

(30) Foreign Application Priority Data

Sep. 8, 2015 (JP) ..... 2015-176400

(51) Int. Cl.
*G03G 15/20* (2006.01)
*G03G 15/00* (2006.01)
*G03G 21/00* (2006.01)

(52) U.S. Cl.
CPC ..... *G03G 15/6585* (2013.01); *G03G 15/205* (2013.01); *G03G 21/00* (2013.01);
(Continued)

(58) Field of Classification Search
CPC ..... G03G 15/2039; G03G 15/205; G03G 15/6582; G03G 15/6585; G03G 2215/00949; G03G 2215/2045
(Continued)

(56) References Cited

U.S. PATENT DOCUMENTS 8,320,811 B2 * 11/2012 Kagawa ..... G03G 7/0026 399/341
8,874,020 B2 * 10/2014 Mita ..... G03G 15/0136 399/335
(Continued)

FOREIGN PATENT DOCUMENTS

JP 06095494 A * 4/1994 ..... G03G 9/0926
JP 2013057939 A * 3/2013 ..... G03G 15/205

*Primary Examiner* — Robert Beatty
(74) *Attorney, Agent, or Firm* — Amin, Turocy & Watson LLP; Gregory Turocy

(57) ABSTRACT

An image forming apparatus comprises an image forming section; a fixing device; an input section; a storage section which stores a target temperature of the fixing device in a case of carrying out the fixing processing and a target temperature of the fixing device in a case of carrying out the erasing processing; and a control section which controls to read out lower one of the target temperature of the fixation and the target temperature of the erasure from the storage section to set the lower one to the target temperature of the fixing device in a case in which the processing information of the fixing processing and the erasing processing is input by the input section and the processing is continuously carried out, and drive the fixing device via the driving section at a driving speed corresponding to each of the fixing processing and the erasing processing.

9 Claims, 7 Drawing Sheets

80

(a)

| | | |
|---|---|---|
| NORMAL FIXING | 60CPM | 160 CENTIGRADE DEGREES |
| ERASING AND FIXING | 60CPM | 96 CENTIGRADE DEGREES |
| ERASING PROCESSING | 60CPM | 130 CENTIGRADE DEGREES |

(b)

| | | |
|---|---|---|
| NORMAL FIXING | 30CPM | 96 CENTIGRADE DEGREES |
| ERASING AND FIXING | 60CPM | 96 CENTIGRADE DEGREES |
| ERASING PROCESSING | 45CPM | 96 CENTIGRADE DEGREES |

(52) U.S. Cl.
CPC ..... *G03G 2215/00949* (2013.01); *G03G 2215/2045* (2013.01)

(58) Field of Classification Search
USPC ..... 399/67, 69
See application file for complete search history.

(56) References Cited

U.S. PATENT DOCUMENTS

| | | | | |
|---|---|---|---|---|
| 9,044,981 | B2 * | 6/2015 | Imamiya | B41J 29/36 |
| 9,188,918 | B1 * | 11/2015 | Ishii | G03G 21/00 |
| 9,348,249 | B2 * | 5/2016 | Ikuta | G03G 15/0121 |
| 2012/0321350 | A1 * | 12/2012 | Ogasawara | G03G 15/2039 399/223 |
| 2014/0212160 | A1 * | 7/2014 | Fukaya | G03G 15/205 399/69 |
| 2015/0253709 | A1 * | 9/2015 | Fukaya | G03G 21/20 399/82 |
| 2016/0001572 | A1 * | 1/2016 | Katayama | B41M 7/0009 347/179 |
| 2016/0033886 | A1 * | 2/2016 | Aoki | G03G 9/0821 399/321 |
| 2016/0054687 | A1 * | 2/2016 | Katakura | G03G 15/2039 399/69 |

* cited by examiner

FIG.3

70

| NUMBER | PROCESSING | NUMBER OF SHEETS | IMAGE INFORMATION |
|---|---|---|---|
| 01 | ERASING AND FIXING | 03 | AAAA |
| 02 | NORMAL FIXING | 04 | BBBB |
| 03 | ERASING PROCESSING | 05 | — |

FIG.4

80

(a)

| | | |
|---|---|---|
| NORMAL FIXING | 60CPM | 160 CENTIGRADE DEGREES |
| ERASING AND FIXING | 60CPM | 96 CENTIGRADE DEGREES |
| ERASING PROCESSING | 60CPM | 130 CENTIGRADE DEGREES |

(b)

| | | |
|---|---|---|
| NORMAL FIXING | 30CPM | 96 CENTIGRADE DEGREES |
| ERASING AND FIXING | 60CPM | 96 CENTIGRADE DEGREES |
| ERASING PROCESSING | 45CPM | 96 CENTIGRADE DEGREES |

FIG.7

| NUMBER | PROCESSING | NUMBER OF SHEETS | IMAGE INFORMATION |
|---|---|---|---|
| 01 | NORMAL FIXING | 04 | BBBB |
| 02 | ERASING PROCESSING | — | — |

IMAGE FORMING APPARATUS AND IMAGE FORMING METHOD HAVING DECOLORIZING FUNCTION IN THE IMAGE FORMING APPARATUS

CROSS-REFERENCE TO RELATED APPLICATION

This application is based upon and claims the benefit of priority from Japanese Patent Application No. 2015-176400, filed Sep. 8, 2015, the entire contents of which are incorporated herein by reference.

FIELD

Embodiments described herein relate generally to an image forming apparatus.

BACKGROUND

As one type of an image forming apparatus, there is known an image forming apparatus equipped with a so-called decoloring apparatus that prints an image on a sheet with the use of a recording material, for example a decolorable toner, and carries out a decoloring processing on the toner for forming the image through heating with a fixing device to erase the image printed on the sheet in order to reuse the sheet on which the image is formed.

Such an image forming apparatus is used for various purposes including an image forming process for forming an image with the decolorable toner, an image forming processing for forming an image with a non-decolorable toner and an erasing process of the image formed on a sheet with the decolorable toner. The foregoing processing is realized by applying heat to the images formed on the sheet. In other words, it is necessary to set a plurality of temperatures such as a temperature necessary for fixing the decolorable toner, a temperature necessary for fixing the non-decolorable toner and a decoloring temperature necessary for erasing the image formed on the sheet with the decolorable toner to enable the image forming apparatus to operate.

DESCRIPTION OF THE DRAWINGS

FIG. 3 is a view schematically illustrating a processing information file according to the present embodiment;

FIG. 4 is a view schematically illustrating a setting file according to the present embodiment;

FIG. 7 is a view schematically illustrating a changed processing information file according to the present embodiment.

DETAILED DESCRIPTION

In a case in which there is a plurality of setting temperatures of the fixing device, it is necessary to decrease the temperature of the fixing device so as to switch the temperature thereof from a high setting temperature to a low setting temperature according to the needs of the processing; however, as much time is spent on heat dissipation of the fixing device, there is a problem that ease of use is not obtainable for an operator.

In accordance with en embodiment, an image forming apparatus, contains an image forming section configured to form an image on an image receiving medium; a fixing device configured to carry out a fixing process for heating the image receiving medium at a predetermined driving speed and a predetermined first target temperature to fix the image formed by the image forming section at the target temperature, or to carry out an erasing process for erasing the image formed on the image receiving medium at a second target temperature different from the first target temperature of the fixing process; a driver configured to drive the fixing device at a plurality of driving speeds; an input section configured to input processing information of at least one of the fixing process and the erasing process; a storage section configured to store a first target temperature of the fixing device in a case in which the fixing device carries out the fixing process and a second target temperature of the fixing device in a case in which the fixing device carries out the erasing process; and a controller configured to control to read out a lower one of the first target temperature of the fixing process and the second target temperature of the erasing process from the storage section to set a temperature of the fixing device to the lower one of the first or second target temperature in a case in which the processing information of the fixing process and the erasing process is input by the input section and the processing is continuously carried out, and drive the fixing device via the driver at the driving speed corresponding to each process of the fixing process and the erasing process.

Hereinafter, an embodiment of the present invention is described with reference to the accompanying drawings. Further, in the present embodiment, an MFP (Multi-Function Peripheral) is exemplified as the image forming apparatus, though a printer, copier, or a facsimile machine can alternatively be employed.

Figure 1:
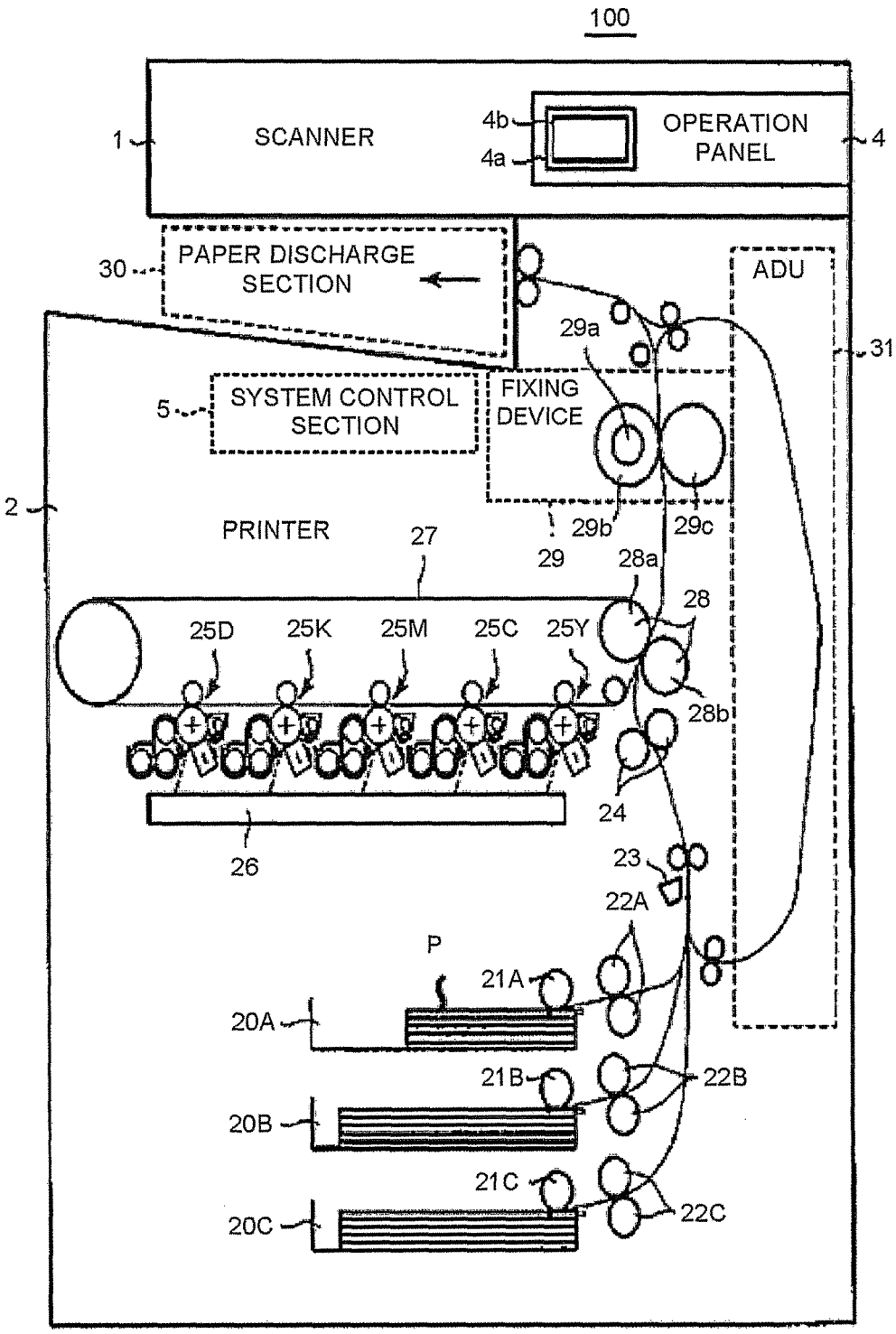
FIG. 1 is a cross-sectional view schematically illustrating an image forming apparatus according to an embodiment.

The present embodiment is described with reference to FIG. 1 to FIG. 7. FIG. 1 is a cross-sectional view schematically illustrating a configuration example of an MFP 100 according to the embodiment. As shown in FIG. 1, the MFP 100 is provided with a scanner section 1, a printer section 2, an operation panel 4 and a system controller 5.

The scanner section 1, for example, arranged on the upper side of a main body of the MET 100, reads an image of a document to convert the image to image data. The scanner section 1 has a well-known configuration equipped with, for example, a CCD line sensor which converts the image of the document on a reading surface to the image data. The scanner section 1 may scan the document placed on a document table glass (not shown) or read the image of the document conveyed by an ADF (Auto Document Feeder). The scanner section 1 is controlled by the system controller 5.

The printer section 2 forms an image on a sheet P as an image receiving medium. In the present embodiment, the printer section 2 is an electrophotographic type image forming section. The printer section 2 can form the image with the use of plural types of toner (for example, five types of toner including yellow (Y) toner, cyan (C) toner, magenta (M) toner, black (K) toner and decoloring (D) toner). The yellow (Y) toner, the cyan (C) toner, the magenta (M) toner and the black (K) toner are non-decolorable toner which cannot be decolored even if they are heated at a predetermined or higher fixing temperature. The decoloring toner (D) is decolorable toner which can be decolored through heating at a predetermined or higher temperature exceeding the fixing temperature. The color of the decoloring toner (D) is, for example, dark blue or black. Furthermore, details of the well-known configuration of carrying out generation of the image by the printer section 2 are described later.

The decoloring toner used in the embodiment is formed by including a color material in binder resin, for example. The decolorable color material contains a color generation compound, a developer and a decoloring agent. As the color generation compound, for example, leuco dye is exemplified. As the developer, for example, phenols are exemplified. As the decoloring agent, a substance which is blended with the color generation compound if heated and does not have affinity to the developer is exemplified. The decolorable color material develops the color through interaction of the color generation compound and the developer, and can be decolored as the interaction of the color generation compound and the developer is cut off through the heating at a temperature equal to or higher than a decoloring temperature.

In the configuration example shown in FIG. 1, the printer section 2 includes a paper feed cassette 20 (20A, 20B and 20C) as a paper feed section. For example, each of the paper feed cassettes 20A, 20B and 20C is arranged at the lower part of the main body of the MFP 100 in a detachable state. These paper feed cassettes 20A, 20B and 20C respectively house the sheets P with different types (for example, different sizes and/or paper qualities) set respectively. It is also possible to, for example, set each of these paper feed cassettes 20A, 20B and 20C to a paper feed cassette corresponding to each size after the sheets with different sizes are respectively housed in the paper feed cassettes 20A, 20B and 20C. A paper feed section sensor is arranged in each of the paper feed cassettes 20A, 20B and 20C. The paper feed section sensor detects the number of the sheets housed in a paper feed tray 22. The paper feed section sensor is, for example, an infrared sensor. In addition, a mechanical sensor can also be used in which a well-known micro switch is arranged. The paper feed section sensor sends a detection result to the system controller 5 described later. Further, the printer section 2 may include a well-known manual feed tray (not shown) as another paper feed section. Furthermore, in the present embodiment, for example, blank sheets P are placed in the paper feed cassette 20A for carrying out image formation. Sheets P for the purpose of erasure are placed in the paper feed cassette 20B. In other words, the sheet P on which the image is already formed with the decolorable toner is placed in the paper feed cassette 20B.

Setting information relating to the sheets P housed by each of the paper feed cassettes 20A, 20B and 20C is stored in a non-volatile memory. The printer section 2 selects a paper feed cassette that houses sheets P to be used in a printing processing according to the setting information. The printer section 2 prints an image on the sheet P fed from the selected paper feed cassette. Furthermore, in a case in which the printer section 2 includes the manual feed tray, a size of a sheet P set in the manual feed tray, which is input from the operation panel 4, may be stored in the foregoing non-volatile memory. T non-volatile memory is an HDD 55 described later.

Furthermore, in the following description, as the sheet is conveyed from the paper feed section 20 to a paper discharge section 30, the paper feed section 20 side is regarded as the upstream side with respect to a sheet conveyance direction, and the paper discharge section 30 side is regarded as the downstream side with respect to the sheet conveyance direction.

A conveyance section 22 shown in FIG. 1, which is arranged along a conveyance path of the sheet in the printer section 2, conveys the sheet. The conveyance section 22 is driven by a motor which is not shown. The conveyance section 22 conveys the sheet supplied from the corresponding paper feed cassette 20A, 20B or 20C through a pickup roller 21A, 21B or 21C to a resist roller 24 arranged at the upstream side of a transfer section 28 described later. The resist roller 24 conveys the sheet to a transfer position at the timing when the image is transferred onto the sheet P from an intermediate transfer belt 27 described later.

Hereinafter, details of the image formation are described. As shown in FIG. 1, an image forming section 25, an exposure section 26, the intermediate transfer belt 27 and the transfer section 28 function as a well-known image forming module for forming an image. The image forming section 25 forms the image to be transferred to the sheet. The configuration example of generating a color image shown in FIG. 1 is described in detail later; however, an image forming section 25Y forms an image corresponding to yellow obtained by color-separating a document image with the yellow toner. An image forming section 25M forms a corresponding image with the magenta toner similarly. An image forming section 25C forms a corresponding image with the cyan toner. An image forming section 25K forms a corresponding image with the black toner. Then, each of the image forming sections 25Y, 25M, 25C and 25K overlaps and transfers the toner image of each color on the intermediate transfer belt 27. On the other hand, the image forming section 25D forms an erasable document image used in a case in which the sheet is reused with the decolorable toner. As stated above, the color of the decolorable toner is the dark blue or black. Thus, the image formed by the image forming section 25D is a monochrome image. Each of the image forming sections 25Y, 25M, 25C, 25K and 25D is composed of the well-known configuration, for example, a photoconductive drum, a charging charger, a developing section containing the toner, a charge removing section and the like (only shown in FIG. 1). The image forming section 25D is used only in a case in which the sheet is reused; however, as only the toner used by the image forming section 25D is different from those used by other image forming sections but the configuration and operations thereof are identical to those of other image forming sections, the image forming section 25D is simultaneously described in the following description.

Hereinafter, an electrophotographic type image formation is described in detail. Each of the image forming sections 25Y, 25M, 25C, 25K and 25D includes a well-known sensor such as a potential sensor and a density sensor (neither is shown). The potential sensor detects surface potential of the well-known photoconductive drum equipped in each image forming section. In each of the image forming sections 25Y, 25M, 25C, 25K and 25D, the well-known charging charger charges the surface of the photoconductive drum before the photoconductive drum is exposed by the exposure section 26 described later. The system controller 5 can change a charging condition of the charging charger. The potential sensor detects the surface potential of the photoconductive drum of which the surface is charged by the charging charger. The density sensor detects density of the toner image transferred onto the intermediate transfer belt 27 described later. Further, the density sensor may detect density of the toner image formed on the photoconductive drum.

The exposure section 26 forms an electrostatic latent image of the document image acquired by the scanner section 1 on the charged photoconductive drum of each of the image forming sections 25Y, 25M, 25C, 25K and 25D through laser light as stated above. The electrostatic latent image formed on each photoconductive drum is an image to be developed with toner of each color. In other words, the exposure section 26 emits the laser light corresponding to each image forming section controlled according to the image data to each photoconductive drum via an optical system such as a polygon mirror. The exposure section 26 controls power of the laser light according to a control signal from the system controller 5. The exposure section 26 also controls a modulation amount of a pulse width for controlling emission of the laser light according to a control signal from the system controller 5.

As stated above, each of the image forming sections 25Y, 25M, 25C, 25K and 25D develops the electrostatic latent image formed on the individual photoconductive drum with the toner of each color by the developing section. Each of the image forming sections 25Y, 25M, 25C, 25K and 25D forms the toner image as a visible image onto the photoconductive drum. The intermediate transfer belt 27 is an intermediate transfer body. In a case in which the color image is formed with the foregoing non-decolorable toner, each of the image forming sections 25Y, 25M, 25C and 25K transfers (primarily transfers) the toner image formed on the photoconductive drum on the intermediate transfer belt 27. Specifically, each of the image forming sections 25Y, 25M, 25C and 25K applies transfer bias to the toner image at a primary transfer position (for example, a portion where the photoconductive drum is contacted with the transfer belt). Each of the image forming sections 25Y, 25M, 25C and 25K controls the transfer bias through a transfer current. The toner image on each photoconductive drum is transferred onto the intermediate transfer belt 27 through the transfer bias at the individual primary transfer position. The system controller 5 controls the transfer current used in a primary transfer processing by each image forming section. On the other hand, in a case in which the sheet is reused, in other words, in a case in which the monochrome image with the decolorable toner is formed, the toner image as the visible image is formed on the photoconductive drum by the image forming section 25D. The toner image is transferred onto the intermediate transfer belt 27 as stated above.

The transfer section 28 which includes a support roller 28*a* and a secondary transfer roller 28*b* arranged along a conveyance path of the sheet P transfers the toner image on the intermediate transfer belt 27 onto the sheet P at a secondary transfer position. The secondary transfer position is a position where the support roller 28*a* and the secondary transfer roller 28*b* are opposite to each other across the intermediate transfer belt 27. The transfer section 28 applies the transfer bias controlled by the transfer current to the intermediate transfer belt 27 at the secondary transfer position. The transfer section 28 transfers the toner image on the intermediate transfer belt 27 onto the sheet P through the transfer bias. The system controller 5 controls the transfer current used in a secondary transfer processing.

A fixing device 29 arranged at the downstream side of the foregoing transfer section 28 has a function of enabling the toner to be fixed on the sheet P. For example, in the embodiment, the fixing device 29 enables the toner image to be fixed on the sheet P through heat and pressure applied to the sheet P.

Figure 5:
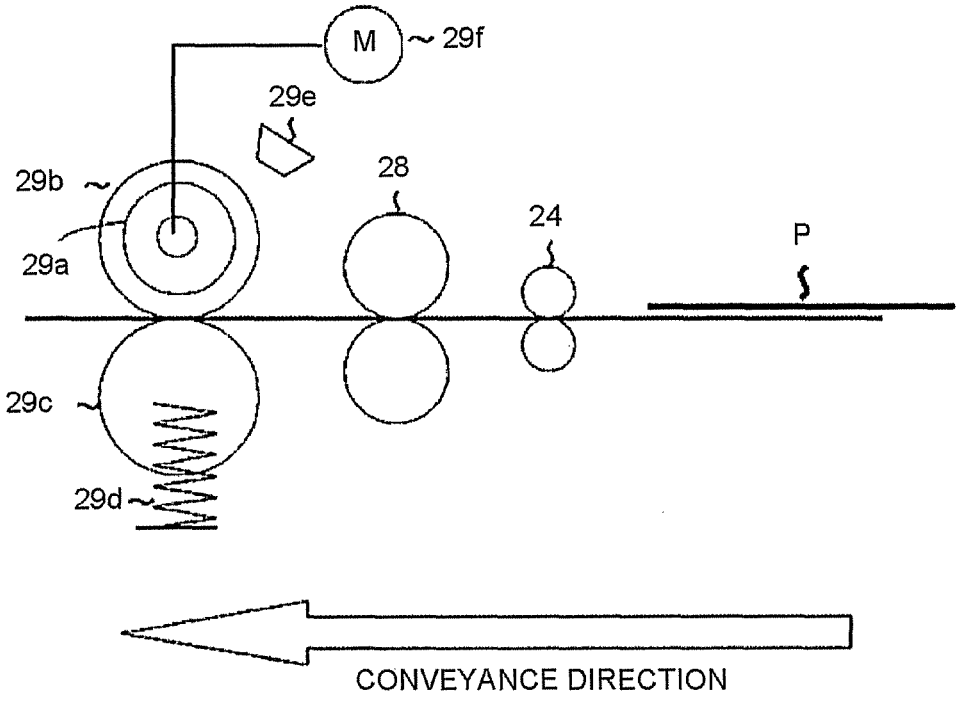
FIG. 5 is a view schematically illustrating a relation of a resist roller, a fixing device and a transfer section according to the present embodiment.

In the configuration examples shown in FIG. 1 and FIG. 5, the fixing device 29 is composed of a heat roller (heating section) 29*b* in which a heating source 29*a* is built and a pressure roller (pressure section) 29*c* contacting therewith in a pressure state through a pressure mechanism 29*d*. The heating source 29*a* may be a well-known heater capable of controlling a temperature. For example, the heating source 29*a* may be constituted by a heater lamp such as a halogen lamp or may be an induction heating (IH) heater. Further, the heating source 29*a* may be constituted by a plurality of heaters. Furthermore, the fixing device 29 includes a temperature sensor 29*e* for measuring the temperature of the heat roller 29*b*. The temperature sensor 29*e* sends the temperature of the heat roller 29*b* to the system controller 5 described later. The system controller 5 controls the heating source 29*a* on the basis of the temperature sent from the temperature sensor 29*e* to control the temperature of the heat roller 29*b*. The pressure mechanism 29*d* presses the pressure roller 29*c* to the heat roller 29*b*. The pressure mechanism 29*d* is constituted by an elastic member. In a case in which the pressure roller 29*c* is not pressed to the heat roller 29*b* by the pressure mechanism 29*d*, the pressure roller 29*c* and the heat roller 29*b* are separated from each other, and a gap is formed between the pressure roller 29*c* and the heat roller 29*b*. Further, the heat roller 29*b* is driven by a driving section 29*f* to rotate. When the pressure roller 29*c* is pressed to the heat roller 29*b*, the pressure roller 29*c* is driven by the heat roller 29*b* to rotate. Furthermore, as shown in FIG. 5, the resist roller 24, the transfer section 28 and the fixing device 29 are arranged in order towards the downstream side of the conveyance direction.

In a case of carrying out a fixing process of enabling the toner image to be fixed on the sheet P or an erasing processing for erasing the image formed on the sheet P, the system control section 5 carries out control in such a manner that the temperature of the fixing device 29 becomes a predetermined fixing temperature or a predetermined decoloring temperature.

In the fixing process, the sheet P housed in the paper feed cassette 20A is picked up by the pickup roller 21A to the conveyance path, and the sheet P is conveyed to the transfer section 28. The image is transferred to the sheet P by the transfer section 28 as stated above. The fixing device 29 presses the sheet P onto which the toner image is transferred through the pressure roller 29*c* and heats the sheet P at a predetermined fixing temperature through the heat roller 29*b* of which the temperature becomes the predetermined fixing temperature. In this way, the fixing device 29 enables the toner image to be fixed on the sheet P. Further, in the erasing process, the sheet P housed in the paper feed cassette 20B is picked up by the pickup roller 21B to the conveyance path, and the sheet P is conveyed to the fixing device 29. At this time, the transfer operation is not carried out by the transfer section 28. The fixing device 29 presses the sheet P on which the image is formed with decolorable toner through the pressure roller 29*c* and heats the sheet P at a predetermined decoloring temperature through the heat roller 29*b* of which the temperature becomes the predetermined decoloring temperature. In this way, the fixing device 29 decolors the toner to erase the image formed on the sheet P.

If the fixing process or the erasing process is completed, through a well-known branching mechanism (not shown) arranged at the downstream side of the fixing device 29, the sheet to which the fixing process is carried out is conveyed to either the paper discharge section 30 or an ADU (Automatic Duplex Unit) 31 in response to a processing request of a user. In a case in which the sheet to which the fixing process is carried out by the fixing device 29 is discharged, the sheet P is conveyed to the paper discharge section 30.

Further, in a case in which the image is also formed on the back surface of the sheet P to which the fixing process is carried out by the fixing device 29, the sheet P is switched back and then conveyed to the ADU 31 after temporarily conveyed to the paper discharge section 30 side. In this case, the ADU 31 supplies the sheet reversed through the switch-back to the upstream side of the resist roller 24 again as shown in FIG. 1.

The operation panel 4 is a user interface. The operation panel 4 which is normally arranged at the front side on the upper part of the main body of the MFP 100 includes various well-known input buttons and a display section 4*a* equipped with a touch panel 4*b*. The system controller 5 controls contents displayed on the display section 4*a* of the operation panel 4. The operation panel 4 outputs information input through the input buttons or the touch panel 4*b* of the display section 4*a* to the system controller 5. The operator operates the operation panel 4 to select either of two modes including a printing mode and an erasing mode. The printing mode refers to a mode for forming the image on the sheet P set in the paper feed cassette 20A with the non-decolorable toner or the decolorable toner and executing the fixing process. The erasing mode is a mode for executing the erasing process of the image formed on the sheet P set in the paper feed cassette 20B. In the other words, the erasing mode erases the image formed on the sheet by using the paper feed section 20, the conveyance section 22 and the fixing device 29 without using the image forming section 25, the exposure section 26, the intermediate transfer belt 27 and the transfer section 28 in the printer section 2. Information such as the number of printing sheets and density necessary for the printing input in the printing mode and information such as the number of erasing sheets relating to each processing input in the erasing mode are stored in a predetermined area of a RAM 54 described later as processing information (the operation panel 4 is equivalent to an input section).

Figure 2:
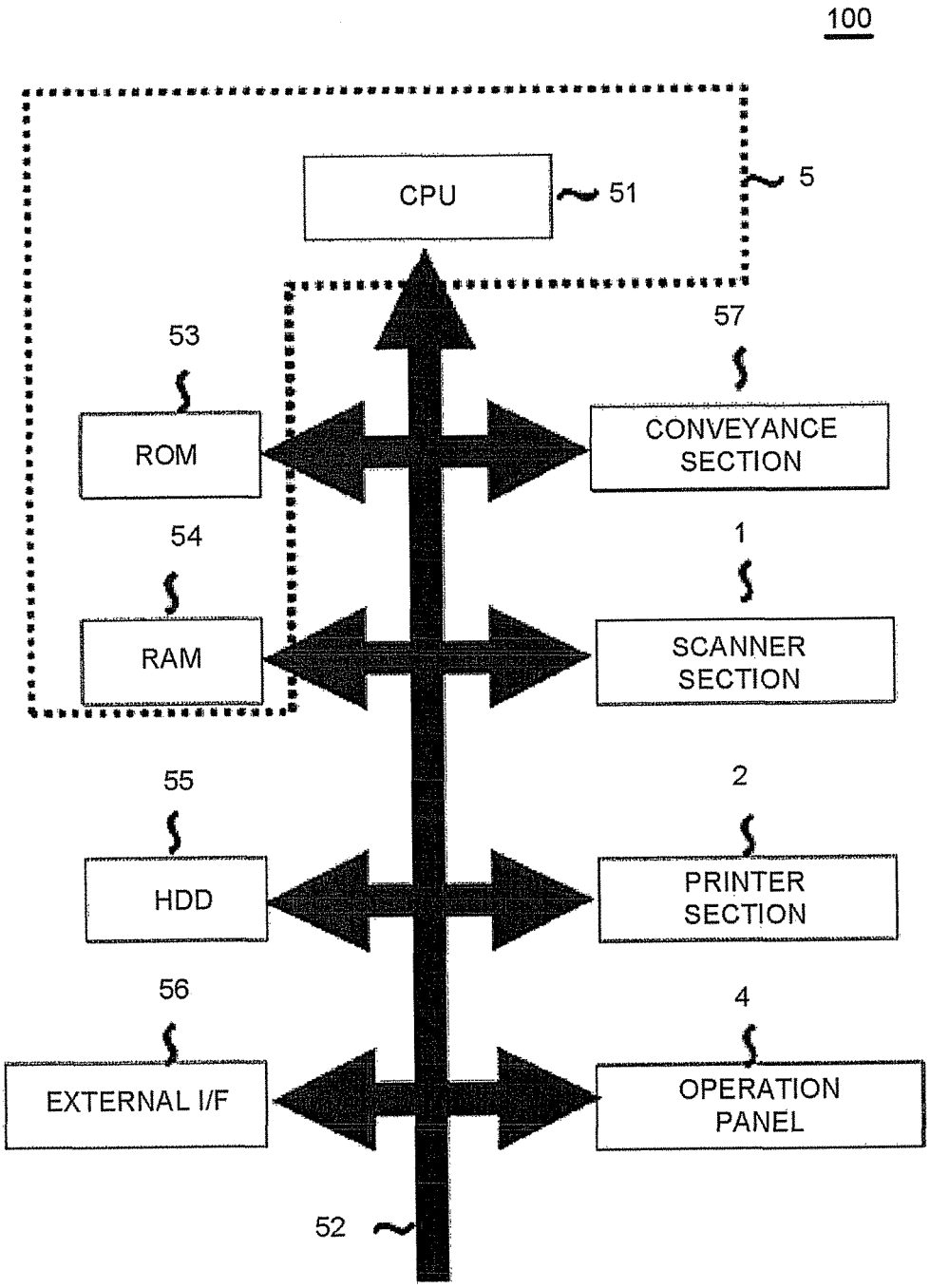
FIG. 2 is a block diagram illustrating the image forming apparatus according to the present embodiment.

Next, the configuration of a control system of the MFP 100 is described. FIG. 2 is a block diagram illustrating the MFP 100 of the present embodiment. A CPU (Central Processing Unit) 51, a ROM (Read Only Memory) 53, a RAM (Random Access Memory) 54, an HDD (Hard Disk Drive) 55, an external I/F (Interface) 56, the conveyance section 57, the printer section 2 and the operation panel 4 are connected with one another via a system bus line 52. The CPU 51, the ROM 53 and the RAM 54 constitute the system controller 5.

A program executed by the CPU 51 and a threshold value are stored in the ROM 53 in advance.

In the RAM 54, various memory areas such as an area in which a program executed by the CPU 51 is copied or decompressed and a working area serving as a job area of a data processing by the program are dynamically formed. Further, the RAM 54 includes an image storage area for storing image information to be printed. The image formation is carried out on the basis of the image information stored in the image storage area, and a primary transfer is carried out onto the intermediate transfer belt 27. The image information stored in the image storage area is received from an external device via an external I/F 56 or stored by acquiring the image of the sheet P through the scanner section 1.

Further, the RAM 54 includes a processing information file 70 (refer to FIG. 3) for storing the processing information input from the operation panel 4. The processing information refers to information input regardless of an automatic operation or a manual operation so as to carry out each processing. The processing information file 70 includes a number area, a processing area, an area for the number of sheets and an image area as shown in FIG. 3. Furthermore, printing information stored in the processing information file 70 contains the density, the size of the sheet and the like, but a part of the printing information is exemplified in FIG. 3. The number area is priority of corresponding processing. The processing is carried out in ascending order of the numbers. The processing area stores a processing of erasing the image or a processing of printing the image. In the processing area, three kinds of processing are stored including an erasing and fixing processing for carrying out the printing with the decolorable toner, a normal fixing process for carrying out the printing with the non-decolorable toner and the erasing process for carrying out the erasure of the image formed on the sheet P. The system controller 5 reads contents of the processing area to determine a processing to be executed. The number of the sheets to be printed in the corresponding processing is stored in the area for the number of sheets. Information for specifying the image information to be printed in the corresponding processing, for example, the name of the image information to be printed, a pass of a storage destination being stored and the like is stored in the image area.

Then, the system controller 5 refers to the processing area in the processing information file 70 to determine whether the MFP 100 operates in a temperature change mode or in a speed change mode. The temperature change mode refers to a mode for changing the target temperature of the heat roller 29*b* for each processing to drive the heat roller 29*b* at a temperature most suitable to the fixation and erasure of the sheet. In a case in which a signal processing is stored in the processing area of the RAM 54, the temperature change mode is selected by the system controller 5. In the temperature change mode, a conveyance speed of the sheet P is constant. It is desirable that the conveyance speed of the sheet P is the maximum speed in the MFP 100. In the present embodiment, the conveyance speed of the sheet P is set to 60 CPM (COPY PER MINUTES: the number of the sheets to be processed in one minute. 60 CPM refers to a speed at which 60 sheets are processed in one minute). Further, the speed change mode refers to a mode for changing the CPM for each processing. In a case in which a plurality of processing is stored in the processing area of the RAM 54, the speed change mode is selected by the system controller 5. In the speed change mode, a target temperature of the heat roller 29*b* is constant. In the speed change mode, among three temperatures including a fixing temperature of the decolorable toner, a fixing temperature of the non-decolorable toner and a decoloring temperature of the erasing processing, the lowest temperature is set to the target temperature of the heat roller 29*b*. In the present embodiment, the lowest temperature is the fixing temperature of the decolorable toner, for example, 96 centigrade degrees is set to the target temperature.

In the HDD 55, an OS (Operating System) for enabling the MFP 100 to operate is installed. Further, as stated above, what kind of sheet is housed in each of the paper feed cassettes 20A, 20B and 20C is stored in the predetermined area of the HDD 55. As shown in FIG. 4, the HDD 55 includes a setting file 80. The setting file 80 stores values for setting respectively in the temperature change mode and in the speed change mode. The setting file 80 includes a CPM area and a temperature area corresponding to a processing area. The processing area stores the processing carried out by the MFP 100. In the processing area, the erasing and fixing processes for carrying out the printing with the decoloring toner, the normal fixing process for carrying out the printing with the non-decolorable toner and the erasing process for carrying out the erasure of the image formed on the sheet P are stored. The CPM area stores a value of a CPM corresponding to a processing stored in a processing area. The temperature area stores target temperatures of the heat roller 29*b* corresponding to the processing stored in a processing area. The values in each mode are described. In the temperature change mode, a temperature change file as shown in FIG. 4 (*a*) is referred. The values stored in FIG. 4 (*a*) are setting values used in the temperature change mode. In the temperature change mode, as stated above, 60 CPM is fixed. In the normal fixing process serving as the fixation of the non-decolorable toner, the target temperature of the heat roller 29*b* is, for example, 160 centigrade degrees. In the erasing and fixing processes serving as the fixation of the decolorable toner, the target temperature of the heat roller 29*b* is, for example, 96 centigrade degrees. The target temperature of the heat roller 29*b* in the erasing process for carrying out the erasure of the image formed on the sheet P is, for example, 130 centigrade degrees. In the speed change mode, the speed change file as shown in FIG. 4 (*b*) is referred. The values stored in FIG. 4 (*b*) are setting values used in the speed change mode. In the speed change mode, the target temperature of the heat roller 29*b* is, for example, 96 centigrade degrees which is constant. In the normal fixing process serving as the fixation of the non-decolorable toner, the MFP 100 is driven at, for example, 30 CPM. In the erasing and fixing processes serving as the fixation of the decolorable toner, the MFP 100 is driven at, for example, 60 CPM. In the erasing process for carrying out the erasure of the image formed on the sheet P, the MFP 100 is driven at, for example, 45 CPM.

Return to FIG. 2. The external I/F 56 is an interface for communicating with an external device such as a client terminal (PC). The external I/F 56 receives print data responding to a print request from the external device. The external I/F 56 may be an interface for carrying out data communication with the external device, for example, a device (a USB memory and the like) locally connected with the external device or a network interface for communicating via a network (the external I/F 56 functions as an input section).

The conveyance section 57 includes a plurality of motors and rollers for conveying the sheet P such as each conveyance roller, the resist roller 24, the driving section 29*f* and the like in the MFP 100. Through the system control section 5, the motor of the conveyance section 57 is controlled, and a rotational speed of each roller such as the heat roller 29*b*, the resist roller 24 and the like is changed. Furthermore, each roller is individually stopped or driven and the speed thereof can be changed as necessary.

The configurations of the scanner section 1, the printer section 2 and the operation panel 4 are described above, and thus the description thereof is omitted.

Figure 6:
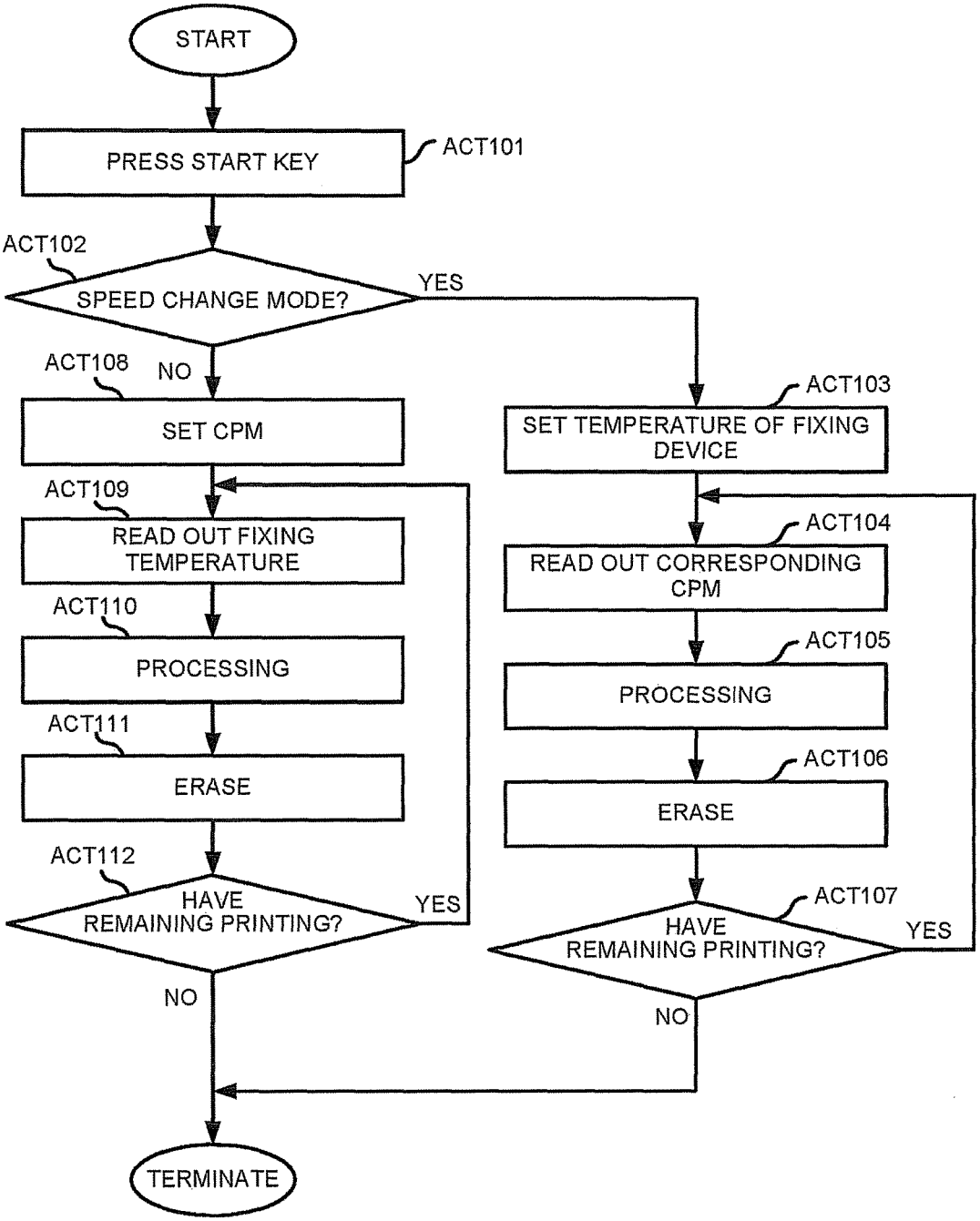
FIG. 6 is a flowchart illustrating a process of a print and erasing job of the image forming apparatus according to the present embodiment.

The MFP 100 with the foregoing configuration executes a print and erasing job shown in FIG. 6 on the basis of a preset program.

The speed change mode and the temperature change mode are respectively described. In a case in which the speed change mode is selected, as stated above, the blank sheet P is placed in the paper feed cassette 20A of the paper feed section 20. The sheet P on which the image is already formed with the decolorable toner is placed in the paper feed cassette 20B. Further, the operator operates the operation panel 4 to input the processing information as shown in FIG. 3 so as to carry out three kinds of processing including the erasing and fixing processes, the normal fixing process and the erasing process. In the processing information file 70 of the RAM 54, three kinds of processing including the erasing and fixing processes, the normal fixing process and the erasing process, the corresponding number of the sheets and the corresponding image information are stored as shown in FIG. 3. In the temperature change mode, a case in which the "normal fixing process" is stored in the whole processing information file 70 of the RAM 54 is described as an example.

Firstly, the speed change mode is described. The system controller 5 detects the input of a key signal of a start key on the operation panel 4 (ACT 101).

If the input of the key signal of the start key is confirmed, the system controller 5 accesses the processing area of the processing information file 70 in the RAM 54 to determine whether a plurality of processing or a signal processing is stored (ACT 102).

As shown in FIG. 3, if a plurality of the processing is stored in the processing area of the processing information file 70 in the RAM 54 (Yes in ACT 102), the system controller 5 enables the MFP 100 to operate in the speed change mode. Specifically, the system controller 5 reads out the value of the temperature area of the speed change file in the setting file 80 of the HDD 55 shown in FIG. 4 (*b*) to heat the heat roller 29*b* to 96 centigrade degrees (ACT 103).

Next, the system controller 5 reads out contents of a processing area corresponding to the minimum numerical value stored in the number area in the processing information file 70 of the RAM 54. In the present embodiment, the "erasing and fixing process" is read. Then, the system controller 5 retrieves the values of the processing area read from the RAM 54 from the processing area of the speed change file in the setting file 80 of the HDD 55. Then, the system controller 5 controls the conveyance section 57 on the basis of the value of the corresponding CPM area in the setting file 80 of the HDD 55. In the case of FIG. 4 (*b*), the sheet is conveyed at 30 CPM (ACT 104).

The system controller 5 refers to the contents of the processing area corresponding to the minimum numerical value stored in the number area in the processing information file 70 of the RAM 54 to carry out the processing (ACT 105). In the case of FIG. 3, the decolorable toner is used to carry out the printing. The system controller 5 refers to the image area in the processing information file 70 of the RAM 54 to specify the image information stored in the image storage area to carry out the printing corresponding to the number of the sheets stored in the area for the number of sheets. In a case of the erasing and fixing processes, the system controller 5 enables the pickup roller 21A to be driven to feed the blank sheet P. The system controller 5 enables the image forming section 25, the exposure section 26, the intermediate transfer belt 27 and the transfer section 28 to be driven to transfer the image formed with the decolorable toner onto the sheet P. if the transfer of the image onto the sheet P is completed, the sheet P is conveyed to the fixing device 29, and the image formed on the sheet P is fixed. Then, the printing of the fixed image is ended and the sheet is discharged to the paper discharge section 30. This process carries out the processing corresponding to the number of the sheets (three sheets).

If the processing in ACT 105 is completed, the system controller 5 deletes the information corresponding to the minimum numerical value stored in the number area in the processing information file 70 of the RAM 54 (ACT 106). In the case of the setting information area of the RAM 54 shown in FIG. 3, the "erasing and fixing processes" in the processing area corresponding to the number area "01", "03"

in the area for the number of sheets and "AAAA" in the image area are deleted. Then, as shown in FIG. 7, the value corresponding to the number area "02" is moved up to the number area "01". In other words, after the processing in ACT 106 is completed, the values corresponding to the number area "01" in the processing information file 70 of the RAM 54 become the "normal fixing process" in the processing area, "04" in the area for the number of sheets and "BBBB" in the image area.

Subsequently, the system controller 5 determines whether or not the processing information that should be used to carry out the processing is stored in the processing information file 70 of the RAM 54 (ACT 107). If it is determined that the processing information is stored in the processing information file 70 of the RAM 54 (Yes in ACT 107), the system controller 5 returns to the processing in ACT 104 again to readout contents of a processing area corresponding to the minimum numerical value stored in the number area in the processing information file 70 of the RAM 54. In the present embodiment, the "erasing process" is read. Then, the system controller 5 retrieves the values of the processing area read from the RAM 54 from the processing area of the speed change file in the setting file 80 of the HDD 55. Then, the system controller 5 controls the conveyance section 57 on the basis of the value of the corresponding CPM area in the setting file 80 of the HDD 55. In the case of FIG. 4 (*b*), the sheet is conveyed at 45 CPM (ACT 104).

On the other hand, if it is determined that no processing information is stored in the processing information file 70 of the RAM 54 (No in ACT 107), the system controller 5 terminates the print and erasing job.

Next, the temperature change mode is described. As stated above, a case in which the "normal fixing process" is stored in the whole processing information file 70 of the RAM 54 is described as an example. Through the foregoing condition, if it is determined that the "normal fixing process" serving as the signal processing is stored in the processing area in the processing information file 70 of the RAM 54 (No in ACT 102), the system controller 5 enables the MFP 100 to operate in the temperature change mode. Specifically, the system controller 5 reads out a value of the CPM area of the temperature change file in the setting file 80 of the HDD 55 shown in FIG. 4 (*a*) to enable the conveyance section 57 to be driven at the value of the corresponding CPM. In the example shown in FIG. 4 (*a*), the MFP 100 is driven at 60 CPM (ACT 108).

Subsequently, the system controller 5 reads out values of a processing area corresponding to the minimum numerical value stored in the number area in the processing information file 70 of the RAM 54. Then, the system controller 5 retrieves the contents of the processing area read from the RAM 54 from the processing area of the temperature change file in the setting file 80 of the HDD 55. Then, the system controller 5 sets the target temperature of the heat roller 29*b* on the basis of the value of the corresponding temperature area in the setting file 80 of the HDD 55. In the embodiment, the "normal fixing process" is read from the processing information file 70 of the RAM 54. The system controller 5 reads out "160 centigrade degrees" in the temperature area corresponding to the "normal fixing process" in the setting file 80 (refer to FIG. 4 (*a*)) of the HDD 55 to set the "160 centigrade degrees" as the target temperature of the heat roller 29*b*. Then, the system control section 5 heats the heat roller 29*b* to 160 centigrade degrees (ACT 109).

The system controller 5 refers to the values of the processing area corresponding to the minimum numerical value stored in the number area in the processing information file 70 of the RAM 54 to carry out the processing (ACT 110).

If the processing in ACT 110 is completed, the system controller 5 deletes the information corresponding to the minimum numerical value stored in the number area in the processing information file 70 of the RAM 54. The processing is identical to that described stated in ACT 106, and thus the detailed description thereof is omitted (ACT 111).

After that, the system controller 5 determines whether or not the processing information that should be used to carry out the processing is stored in the processing information file 70 of the RAM 54 (ACT 112). If it is determined that no processing information is stored in the processing information file 70 of the RAM 54 (No in ACT 112), the system controller 5 terminates the print and erasing job.

On the other hand, if it is determined that the processing information is stored in the processing information file 70 of the RAM 54 (Yes in ACT 112), the system controller 5 returns to the processing in ACT 104 again to enable the conveyance section 57 to be driven at the CPM corresponding to the value in the processing area corresponding to the minimum numerical value stored in the number area in the processing information file 70 of the RAM 54.

Through the above, for example, in a case of continuously carrying out the fixing processing with the decolorable toner after carrying out the erasing processing, the MFP 100 of the present embodiment operates in the speed change mode (refer to FIG. 4 (*b*)). In other words, in a case in which the heat roller 29*b* is heated at the target temperature 96 centigrade degrees and the driving section 29*f* carries out operates at 45 CPM in the erasing processing, the driving section 29*f* operates at 60 CPM. In this way, it is not necessary to wait for that the temperature of the heat roller 29*b* drops from 130 centigrade degrees serving as the temperature at which the erasing processing is carried out to 96 centigrade degrees. As a result, as the speed of the MFP 100 at which the sheet is processed is increased, it is possible to provide an easy-to-use MFP to the operator.

Furthermore, in one embodiment of the present invention, the fixing temperature of the non-decolorable toner is greater than the decoloring temperature of the decolorable toner which is greater than the fixing temperature of the decolorable toner; however, the present invention is not limited to this as the temperatures can have a different relative relationship.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form an image on an image receiving medium;

a fixing device configured to carry out a fixing process for heating the image receiving medium at a predetermined driving speed and a predetermined first target temperature to fix the image formed by the image forming section at the target temperature, or to carry out an erasing process for erasing the image formed on the image receiving medium at a second target temperature different from the first target temperature of the fixing process;

a driver configured to drive the fixing device at a plurality of driving speeds; an input section configured to input processing information of at least one of the fixing process and the erasing process;

a storage section configured to store a first target temperature of the fixing device in a case in which the fixing device carries out the fixing process and a second target temperature of the fixing device in a case in which the fixing device carries out the erasing process; and a controller configured to control to read out a lower one of the first target temperature of the fixing process and the second target temperature of the erasing process from the storage section to set a temperature of the fixing device to the lower one of the first or second target temperature in a case in which the processing information of the fixing process and the erasing process is input by the input section and the processing is continuously carried out, and drive the fixing device via the driver at the driving speed corresponding to each process of the fixing process and the erasing process.

2. The image forming apparatus according to claim 1, wherein the image forming section forms an image with at least one of a decolorable color material and a non-decolorable color material;

the fixing device carries out the fixing process at a temperature corresponding to the decolorable color material or the non-decolorable color material and the erasing process at another temperature corresponding to the decolorable color material;

the processing information of the fixing process input by the input section comprises a command for forming an image with at least one of the decolorable color material and the non-decolorable color material;

the first target temperature of the fixing process in the storage section comprises a first fixing temperature of the image formed with the decolorable color material and a second fixing temperature of the image formed with the non-decolorable color material; and in a case in which processing information of the fixing process and the erasing process with the decolorable color material and the fixing process with the non-decolorable color material is input by the input section and the processing is continuously carried out, the controller controls to read out the lowest target temperature of the fixing device among the processing from the storage section to set the lowest target temperature to the target temperature of the fixing device and change the driving speed of the driving section in response to the processing.

3. The image forming apparatus according to claim 2, wherein in a case in which any one of the fixing processing and the erasing processing with the decolorable color material and the fixing processing with the non-decolorable color material is input by the input section and the input processing is carried out, the control section reads out a target temperature corresponding to the processing input by the input section from the storage section to set the read target temperature to the lowest target temperature of the fixing device.

4. The image forming apparatus according to claim 2, further comprising a processing information storage section configured to store each processing input by the input section, wherein the controller determines whether or not a plurality of different processing is stored in the processing information storage section, and if it is determined that a plurality of the different processing is stored, reads out the lowest target temperature of the fixing device among the processing stored in the processing information storage section from the storage section to set the lowest target temperature to the target temperature of the fixing device, and changes the driving speed of the driving section in response to the processing.

5. The image forming apparatus according to claim 3, further comprising a processing information storage section configured to store each processing input by the input section, wherein the controller determines whether or not a plurality of different processing is stored in the processing information storage section, and if it is determined that a plurality of the different processing is stored, reads out the lowest target temperature of the fixing device among the processing stored in the processing information storage section from the storage section to set the lowest target temperature to the target temperature of the fixing device, and changes the driving speed of the driving section in response to the processing.

6. An image forming method, comprising:

forming an image on an image receiving medium;

fixing by heating the image receiving medium at a predetermined driving speed and a predetermined first target temperature to fix the image at the target temperature, or erasing the image formed on the image receiving medium at a second target temperature different from the first target temperature of the fixing;

driving the fixing at a plurality of driving speeds;

inputting processing information of the fixing or the erasing;

storing a first target temperature of the fixing and a second target temperature of the erasing; and reading out lower one of the first target temperature of the fixing and the second target temperature of the erasing to set a temperature to the lower one of the first or second target temperature and drive the fixing at the driving speed corresponding to each of the fixing and the erasing, wherein the image is formed with at least one of a decolorable color material and a non-decolorable color material;

fixing is carried out at a temperature corresponding to the decolorable color material or the non-decolorable color material and erasing is carried out at another temperature corresponding to the decolorable color material; and in a case in which fixing and erasing with the decolorable color material and fixing with the non-decolorable color material is continuously carried out, setting the lowest target temperature to the target temperature of the fixing and changing the driving speed in response to the processing.

7. The image forming apparatus according to claim 6, wherein in a case in which any one of the fixing and erasing with the decolorable color material and the fixing with the non-decolorable color material is carried out, setting the read target temperature to the target temperature of the fixing.

8. The image forming apparatus according to claim 6, further comprising storing each processing input, wherein determining whether or not a plurality of different processing is stored, and if it is determined that a plurality of the different processing is stored, reading out the lowest target temperature of the fixing device among the processing stored to set the lowest target temperature to the target temperature of fixing, and changing the driving speed in response to the processing.

9. The image forming apparatus according to claim 7, further comprising storing each processing input, wherein determining whether or not a plurality of different processing is stored, and if it is determined that a plurality of the different processing is stored, reading out the lowest target temperature of the fixing among the processing stored to set the lowest target temperature to the target temperature of the fixing, and changing the driving speed in response to the processing.

* * * * *